US005442583A

United States Patent [19]

Kirk et al.

[11] Patent Number: 5,442,583

[45] Date of Patent: Aug. 15, 1995

[54] COMPENSATED ANALOG MULTIPLIERS

[75] Inventors: David B. Kirk, South Pasadena; Alan H. Barr, Pasadena, both of Calif.

[73] Assignee: California Institute of Technology, Pasadena, Calif.

[21] Appl. No.: 61,849

[22] Filed: May 14, 1993

[51] Int. Cl.[6] ..... G06G 7/16

[52] U.S. Cl. ..... 364/841; 364/844

[58] Field of Search ..... 364/841, 842, 843, 844; 330/253; 307/529

[56] References Cited

U.S. PATENT DOCUMENTS

| | | | |
|---|---|---|---|
| 4,935,702 | 6/1990 | Mead et al. | 330/9 |
| 5,059,920 | 10/1991 | Anderson et al. | 330/253 |
| 5,061,866 | 10/1991 | El-Naggar et al. | 364/841 |
| 5,068,622 | 11/1991 | Mead et al. | 330/253 |
| 5,254,889 | 10/1993 | Han | 364/841 |

OTHER PUBLICATIONS

Kirk, David B., Kurk Fleischer, Lloyd Watts, and Alan Barr, "Constrained Optimization applied to the Parameter Setting Problem for Analog Circuits", Neural Information Processing Systems 4, Morgan Kaufman, Palo Alto, Calif., 1992.

Denyer, Peter B., and John Mavor, "MOST Transconductance Multipliers for Array Applications", IEEE Proceedings, vol. 128, Pt. 1, No. 3, pp. 81-86, Jun. 1981.

Denyer, Peter B., Colin F. N. Cowan, John Mavor, Christopher B. Clayton, and John L. Pennock, "A Monolithic Adaptive Filter", IEEE Journal of Solid-State Circuits, vol. SC-18, No. 3, pp. 291-296, Jun. 1983.

Babanezhad, Joseph N., and Garbor C. Temes, "A 20-V Four-Quadrant CMOS Analog Multiplier", IEEE Journal of Solid-State Circuits, vol. SC-20, No. 6, pp. 1158-1168, Dec. 1985.

Mead, C. A., "Analog VLSI and Neural Systems", Addison-Wesley, pp. 233-242, 1989.

Tsividis, Yannis, Mihai Banu, and John Khoury, "Continuous-Time MOSFET-C Filters in VLSI", IEEE Transactions on Circuits and Systems, vol. CAS-33, No. 2, pp. 125-140, Feb. 1986.

*Primary Examiner*—Tan V. Mai

*Attorney, Agent, or Firm*—Blakely, Sokoloff, Taylor & Zafman

[57] ABSTRACT

The multiplier which includes built-in adjustments to improve circuit performance. More specifically, the multiplier is a compensated multiplier to increase the accuracy and precision of computation using analog very large scale integrated (VLSI) circuits and consists of adjustable parameters which allow for the improvement of the linear range of behavior as well as the cancellation of input offsets. A differential multiplier is further described in which adjustable parameters in addition to the four inputs to the multiplier compensate for offsets and non-linearities to result in a highly accurate analog multiplier.

21 Claims, 15 Drawing Sheets

COMPENSATED ANALOG MULTIPLIERS

BACKGROUND OF THE INVENTION

1. Field of the Invention

The present invention relates to analog VLSI circuitry, specifically compensated multipliers.

2. Art Background

The use of analog VLSI circuitry to implement functions traditionally performed with digital components is becoming more and more common. In addition, Analog VLSI is being used more frequently to model complex systems that are often simulated in software. For example, Mead has been a proponent of using analog VLSI to implement neural systems. See, Mead, *Analog VLSI Neural Systems*, (Addison Wesley, 1989). An important component of the work lies in the attempt to mimic the adaptation that real biological neurons are able to do. Therefore, modeling analog VLSI simulations of neural systems requires producing circuits that are intrinsically adaptive. Another component of this design philosophy is the exploration of architectures and circuits that are tolerant of device variations and perform computations collectively.

Other research is focused on increasing the accuracy and precision of computation with analog VLSI and on developing a design methodology for creating analog VLSI circuits which can be adjusted to perform to the desired accuracy. See, Kirk, Fleischer, Barr, and Watts, "*Constrained Optimization Applied to the Parameter Setting Problem for Analog Circuits,*" IEEE Neural Information Processing Systems, 1991 (NIPS 91), (Morgan Kaufman, San Diego, 1991).

It is possible to make analog circuits more quantitatively useful by designing compensatable circuit building blocks that can be adjusted to perform more closely to some performance metric. An example is the CMOS amplifier with offset adaptation, U.S. Pat. No. 5,068,622, Mead, et al. Mead describes an integrated circuit amplifier having a random input offset voltage that is adaptable to cancel the input offset voltage. However, application of this concept to other types of devices is not straightforward. For example, an ideal linear differential multiplier produces the product P according to the following equation:

$$P=K(X-X_0)\,(W-W_0)$$

where X, $X_0$, W, $W_0$ are the four input parameters which form the two differential inputs $(X-X_0)$ and $(W-W_0)$. Implementation in analog VLSI, for example, as a two transistor differential multiplier shown in FIG. 1, will yield a less desirable function:

$$P=K_2(X-X_0)\,(W-W_0)+Q$$

where $K_2$ is not a constant factor, but may be a function of the inputs, and Q is an additive offset, which also may be a function of the inputs. Thus, the offsets generated are dictated by at least four input parameters, which must be controlled in a coordinated fashion in order to achieve the desired output.

SUMMARY OF THE INVENTION

It is therefore an object of the present invention to provide a compensated analog multiplier circuit.

It is further an object of the present invention to improve and control the performance of multipliers in terms of offsets, that is, errors in controlling the input parameters, and non-linearities (variations over the operating range).

The multiplier of the present invention includes built-in adjustments to improve circuit performance. More specifically, the multiplier of the present invention is a compensated multiplier which increases the accuracy and precision of computation using analog VLSI circuits. The multiplier circuit of the present invention includes adjustable parameters which allow for the improvement of the linear range of behavior as well as the cancellation of input offsets. A differential multiplier is described in which adjustable parameters in addition to the four inputs to the multiplier compensate for offsets and non-linearities, resulting in a highly accurate analog multiplier.

In the multiplier of the present invention, the individual input offsets are corrected separately in order that increased accuracy is obtained. For example, in a differential multiplier, it is desirable to compute a product P according to the following equation:

$$P=K(X-X_0)\,(W-W_0)$$

where X, $X_0$, W, and $W_0$ are the four input parameters which form the two differential inputs $(X-X_0)$ and $(W-W_0)$.

The performance of the multiplier is improved by compensating individually for the offsets introduced either by errors in controlling X, $X_0$, W and $W_0$, or by variations between transistors in the circuit. Adjustable parameters in addition to the input parameters are included in the circuit and are adjusted to compensate for input offsets.

BRIEF DESCRIPTION OF THE DRAWINGS

The objects, features and advantages of the present invention will become apparent to one skilled in the art from reading the following detailed description in which.

DETAILED DESCRIPTION OF THE INVENTION

In the following description, for purposes of explanation, numerous details are set forth in order to provide a thorough understanding of the present invention. However, it will be apparent to one skilled in the art that these specific details are not required in order to practice the invention. In other instances, well known electrical structures and circuits are shown in block diagram form in order not to obscure the present invention unnecessarily.

Figure 1:
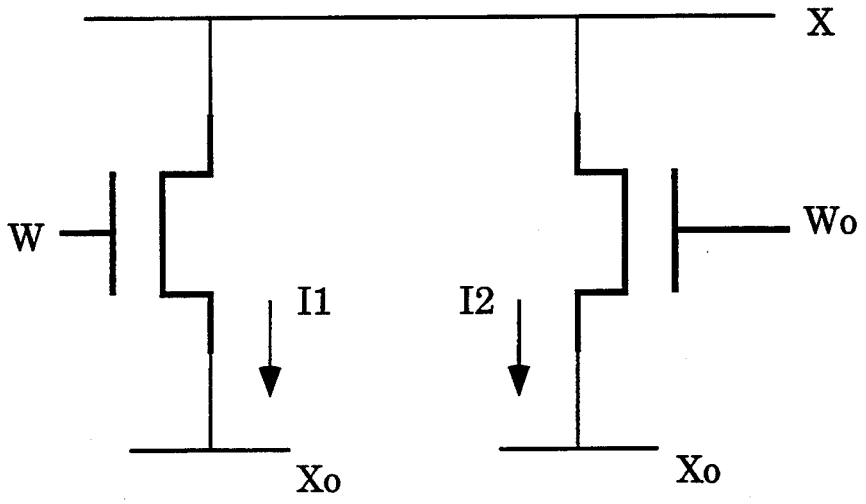
Figure 1 (Prior Art)
FIG. 1 is an illustration of a prior art two transistor multiplier.
Figure 2A:
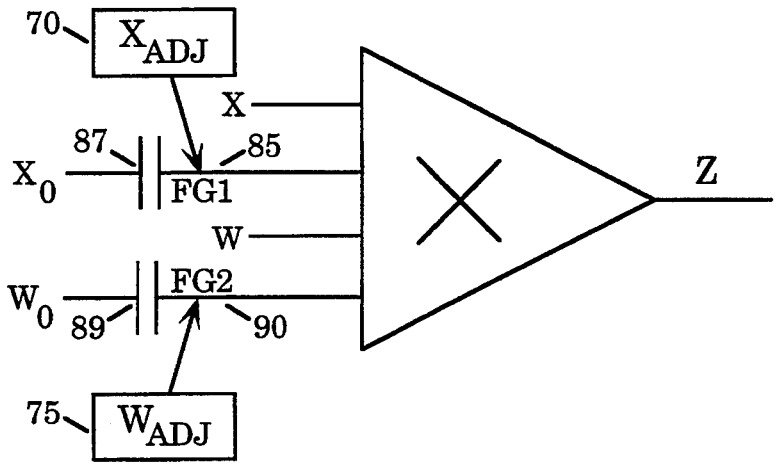
FIG. 2*a* is an illustration of a generic compensated transistor multiplier and FIG. 2*b* is an illustration of a compensated two transistor multiplier in accordance with the teachings of the present invention.

The present invention is directed to multiplier circuits that include a "knob" or "knobs" for the correction of input offsets. A block diagram representation of a compensated multiplier in accordance with the teachings of the present invention is shown in FIG. 2*a*. Floating gates FG1, 85 and FG2, 90 are located between the input to the multiplier and capacitors 87, 89 which are respectively coupled to input signals Xo and Wo. The control adjustments Xadj 70 and Wadj 75 are used to add or subtract charge from the floating gates 85, 90 in order to reduce the input offsets for (X−X0) and (W−W0). To adjust the gates 85, 90 values are input for X, X0, W, W0 and the floating gates 85, 90 are empirically adjusted by control adjustments 70, 75 to reduce the error between the desired output and actual output. For example, it is desirable to reduce the offsets for input values that should produce a multiplier output of zero.

Figure 2B:
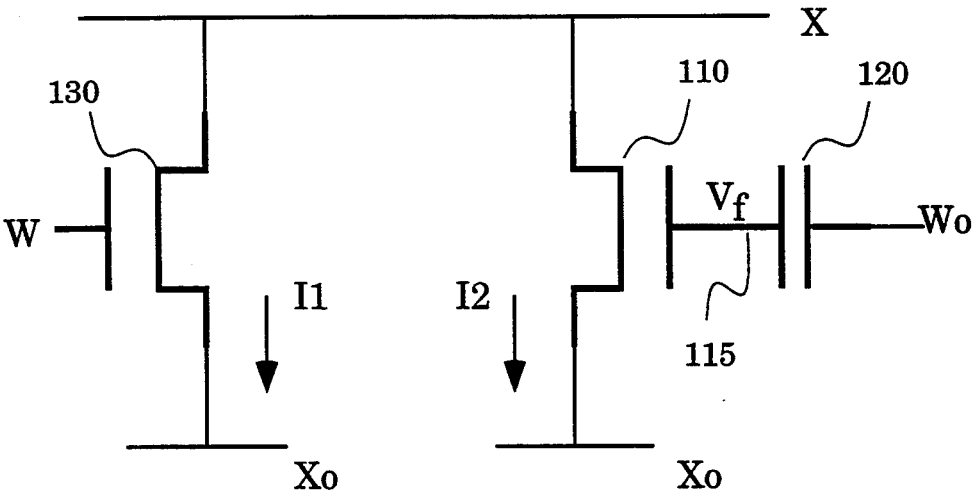

An example of a compensated two transistor multiplier in accordance with the teachings of the present invention is shown in FIG. 2*b*. The four inputs to the two transistor multiplier are X, W, $X_0$ and $W_0$. $W_0$ and $X_0$ are considered reference voltages for W and X, respectively. Between the input $W_0$ and the gate of transistor 110, a floating node $V_f$ 115 is provided. Specifically, the floating node $V_f$ 115 is located between capacitor 120 and the gate of transistor 110. Using a tunneling process, charge can be added or subtracted from the floating node $V_f$ 115, to correspondingly change the voltage at the gate of transistor 110 for a given value of the input voltage $W_0$ and compensate for offsets which occur at the node.

The tunneling process, known to those skilled in the art, permits the addition or subtraction of charge from a node of the capacitor 120 which is the floating node $V_f$. An exemplary tunneling process is described in U.S. Pat. No. 5,059,920, wherein the voltage at the floating node can be changed by electrical control.

Referring to FIG. 2*b*, when W is equal to $W_0$ and $(X-X_0)$ is large, the current through transistors 120, 130 should be equal. However, if an input offset exists, the currents will be different. Typically, input offsets occur due to differences in fabrication wherein, even though the transistors have identical source, drain and gate voltages, the currents through the transistors are different. These offsets frequently occur in analog VLSI transistors. To compensate for the differences between transistors, the charge on the floating gate 115 is changed until the currents in the two transistors are equal. When the current through transistors 120, 130 are equal, the corresponding multiplier output corresponds to zero. Therefore, when $W=W_0$, the output of the multiplier should be zero, since zero multiplied by any number should also be zero.

When $X=X_0$, the current through each transistor should be zero, whether or not the quantity $(W-W_0)$ is large. As no potential difference exists between the source and drain of a CMOS transistor, no current will flow. Although no input offsets occur, offsets may arise due to errors in the control of the input voltages X and $X_0$. When the current through the transistors 120, 130 is equal to zero, the corresponding multiplier output is zero. Therefore, when $X=X_0$, the output of the multiplier should be zero, because zero multiplied by any number should also be zero. Errors in controlling the input voltages X and $X_0$ can be corrected using external circuitry. For example, referring to FIG. 3, the voltage $X_0$ may be controlled using a sense amplifier 140, 150 which also senses the current in the transistors. In this embodiment, the design of the sense amplifier includes adjustments for choosing an appropriate value for $X_0$. For example, referring to FIG. 3 the reference input $V_{ref}$ to the sense amplifier can be changed to change the voltage $X_0$.

Figure 3:
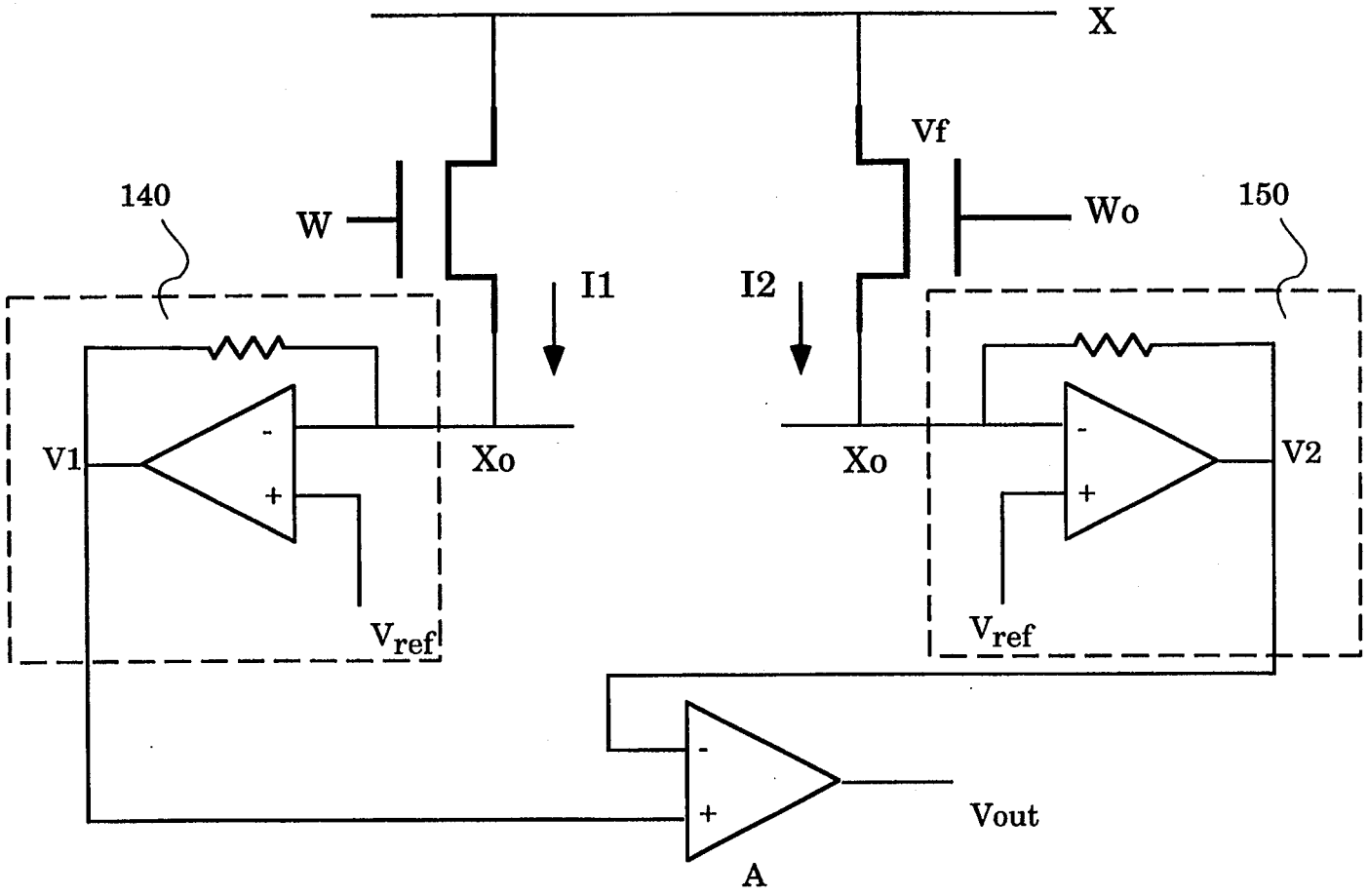
FIG. 3 illustrates a circuit which utilizes one embodiment of the compensated multiplier of the present invention.

FIG. 3 further illustrates how the compensated differential amplifier of the present invention may be used. Sense amplifiers 140, 150 convert current I1, I2 into voltages V1, V2, to produce an output voltage $V_{out}$ proportional to V1−V2 which is in turn proportional to the product $(X-X_0)(W-W_0)$.

Figure 4A:
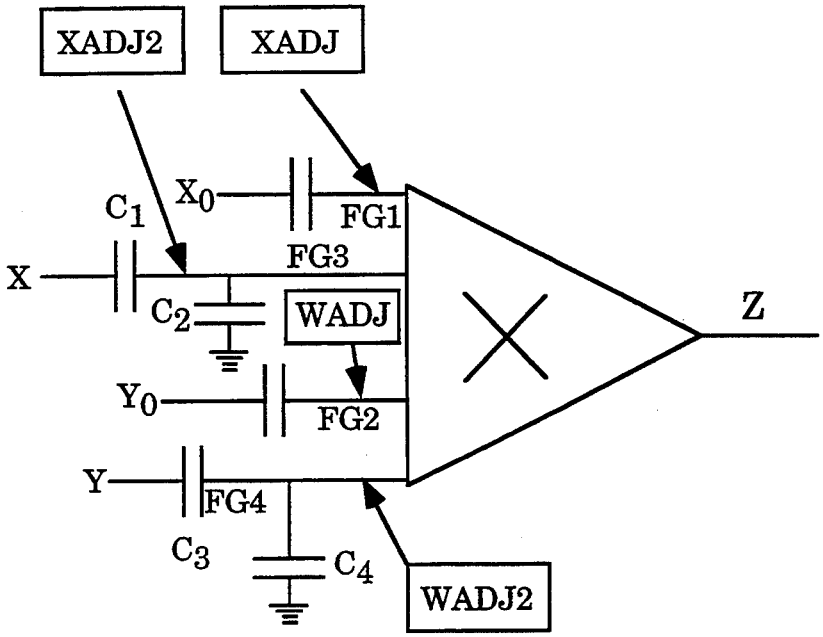
FIGS. 4*a* and 4*b* illustrate a generic and specific implementation of alternate embodiments of the present invention which includes a second floating node for improved linear range.

In an alternate embodiment, the differential multiplier circuit includes adjustment to extend the linear range of the multiplier. This is desirable as an analog VLSI multiplier may deviate from linear operation, particularly at extreme values of the inputs. Therefore, the multiplier is typically more linear for smaller input. To expand the linear range, the inputs to the multiplier are rescaled such that the externally presented inputs cover a larger range than the circuit inputs. This allows the multiplier to operate within a narrower, more linear range, while the external inputs vary over a larger range. This is achieved by dividing the inputs before presenting them to the multiplier core circuit. One way to perform this input division is through capacitive division. FIG. 4*a* is a block diagram illustration showing additional modifications to the multiplier to provide for an increased linear operating range. The input X is scaled by the factor $C_1/(C_1+C_2)$. For example, if C1=C2, the input range is divided in half. The adjustment controls Xadj2 and Wadj2 can adjust the amount of charge on the floating gates FG3 and FG4 which sets the reference value for the input to the multiplier. It should be noted that FG1 and FG3 provide redundant control of input offsets; therefore, alternately, FG1 and Xadj can be eliminated, such that $X_0$ functions as a preset reference and FG3 is adjusted to correct for the input offset. Likewise, FG2 and Yadj can be similarly eliminated.

Figure 4B:
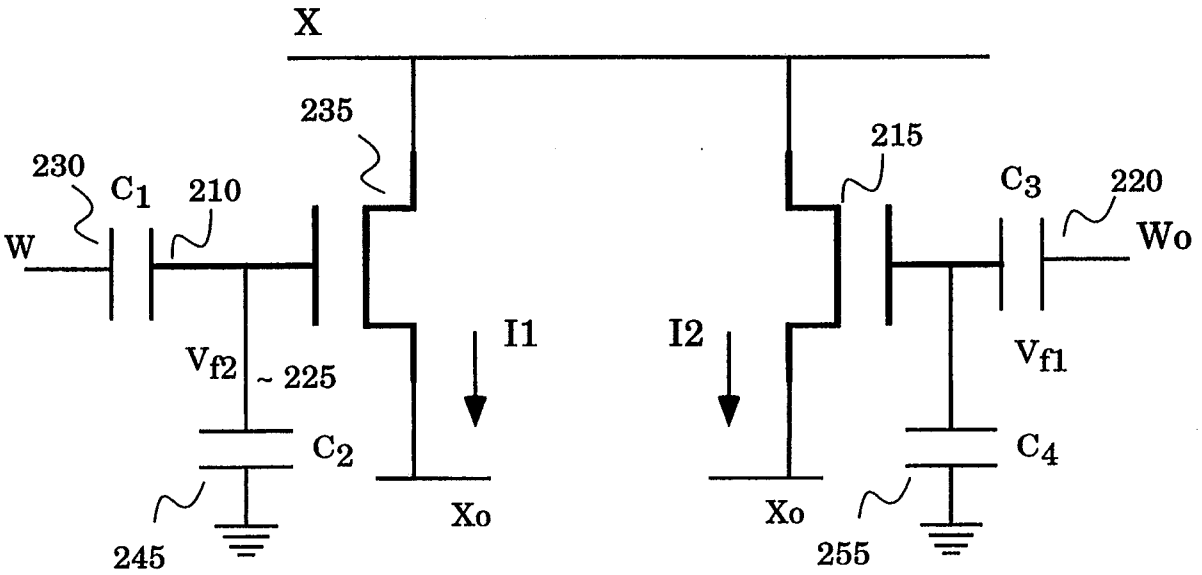

A further example is shown in the circuit of FIG. 4*b*. Floating node 210 is coupled to the gate of transistor 235 and capacitor 230. A second floating node 225 is coupled to the gate of transistor 235, and capacitor 245. This structure allows for the input W to be capacitively divided, so that a change in W creates a smaller change on the gate of transistor 235. The resultant change can be adjusted by modifying the values of capacitors 230, 245 as the output is affected by the capacitive ratio $C_1/(C_1+C_2)$. The capacitive division has the effect of increasing the range for the input W for a given output, because a larger value of W is now required to produce the same voltage on the gate of transistor 235.

As noted earlier, $W_0$ functions as the reference voltage and typically should not change in value. Therefore it is optional to provide a second capacitor 255 and floating node to extend the linear range for input node $W_0$.

Figure 5:
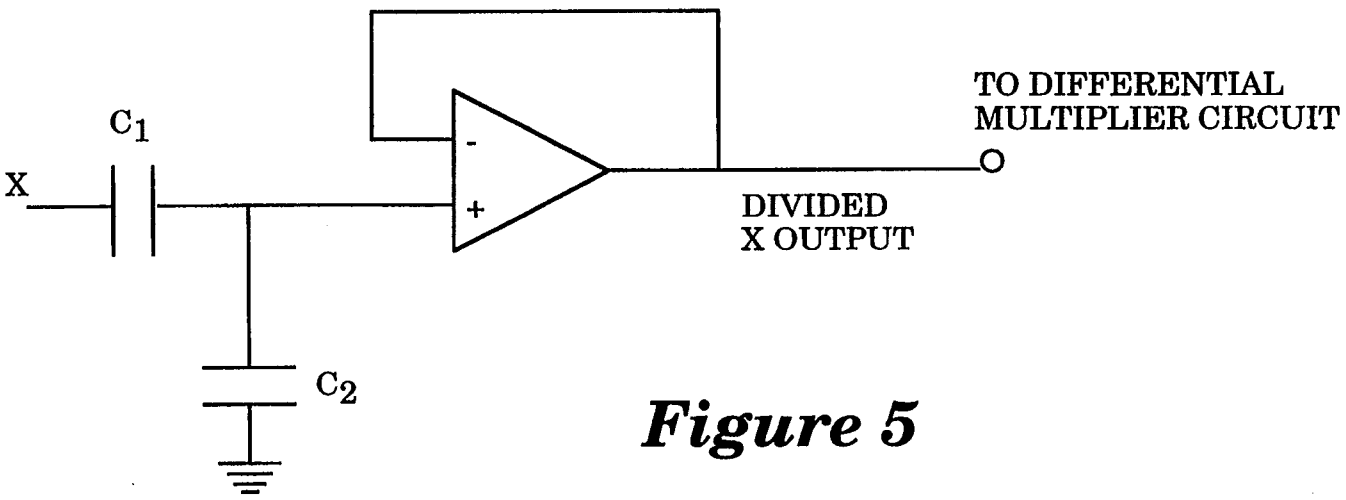
FIG. 5 illustrates exemplary circuitry for expanding the linear range of the multiplier of the present invention.

In order to increase the linear range for the other differential pair of inputs (X, $X_0$), the external circuitry that generates the X value is modified such that the X input is divided as well. FIG. 5 is an exemplary external circuit that uses capacitive division in conjunction with an amplifier to produce an X value divided by the ratio of $C_1/(C_1+C_2)$. It should be noted that similar external circuitry may be used to divide the input value $X_0$; however, as $X_0$ is usually a reference value which does not change, the additional circuitry is not necessary.

In an alternate embodiment, another technique to expand the range of the multiplier is to select a particular mapping between the desired range of numbers and acceptable electrical signals to the circuit.

Figure 6A:
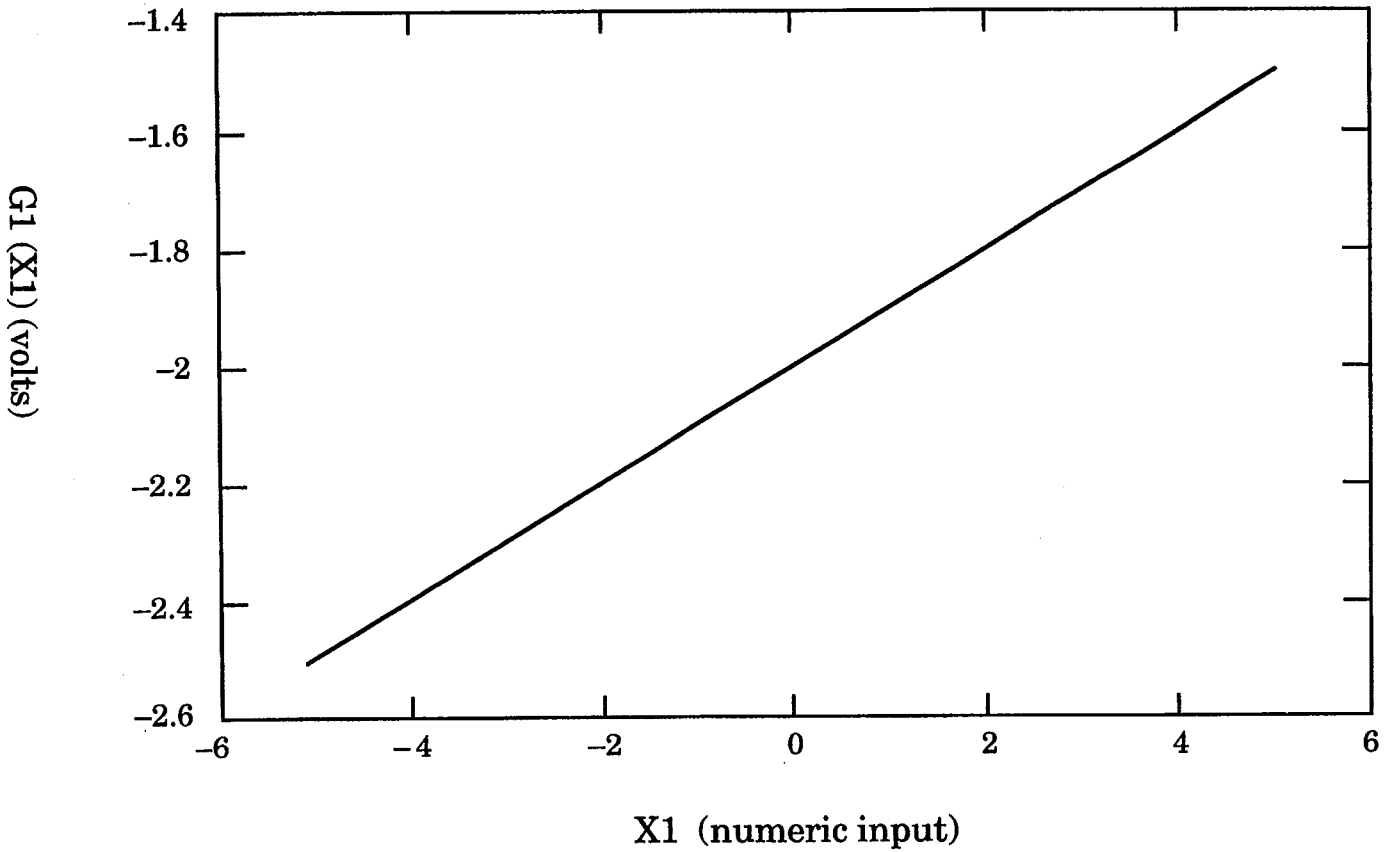
FIGS. 6*a*, 6*b* and 6*c* illustrate signal mappings $G_1(X)$, $G_2(W)$ and $G^{-1}(Vout)$ utilized to further expand the linear range of the multiplier of the present invention.
Figure 6B:
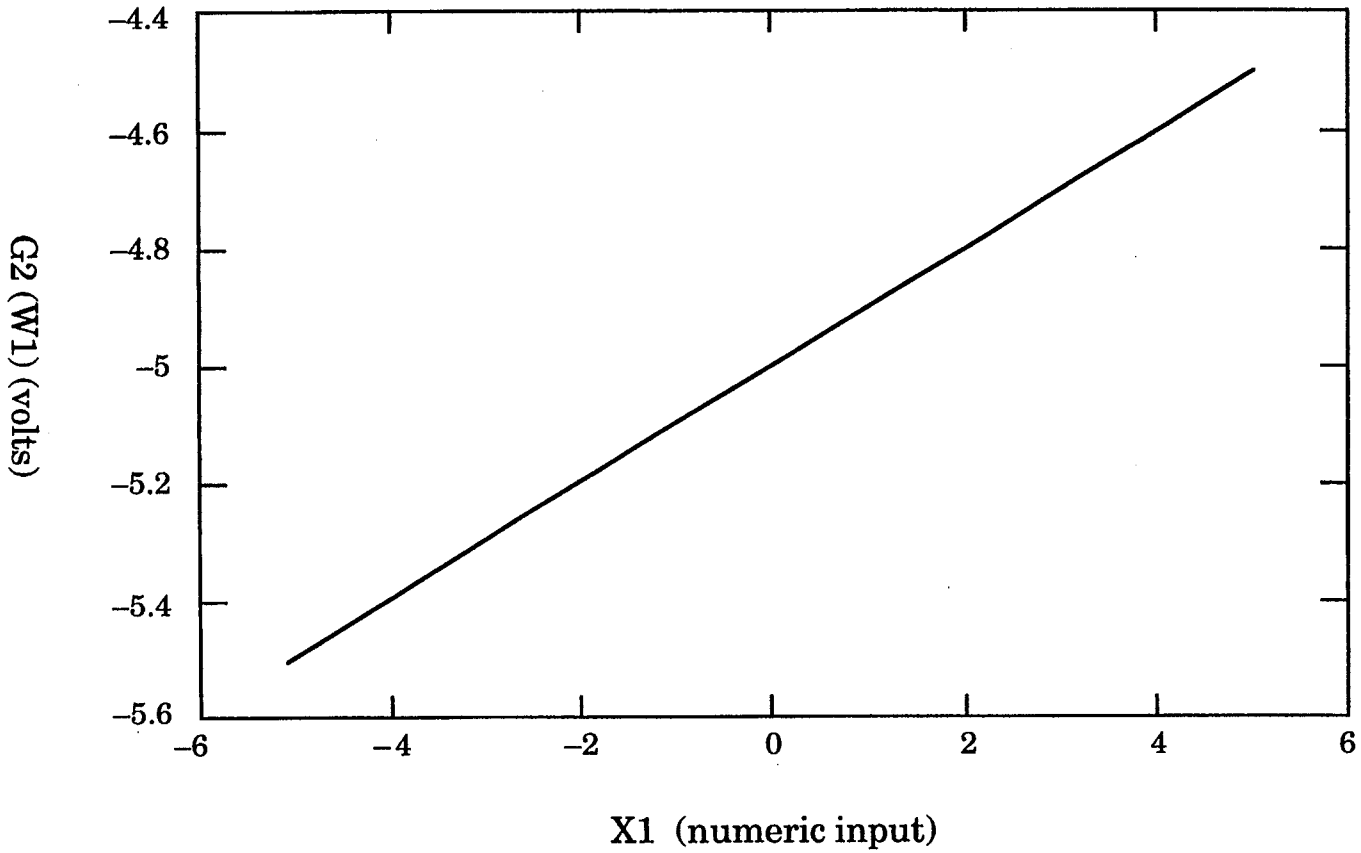
Figure 6C:
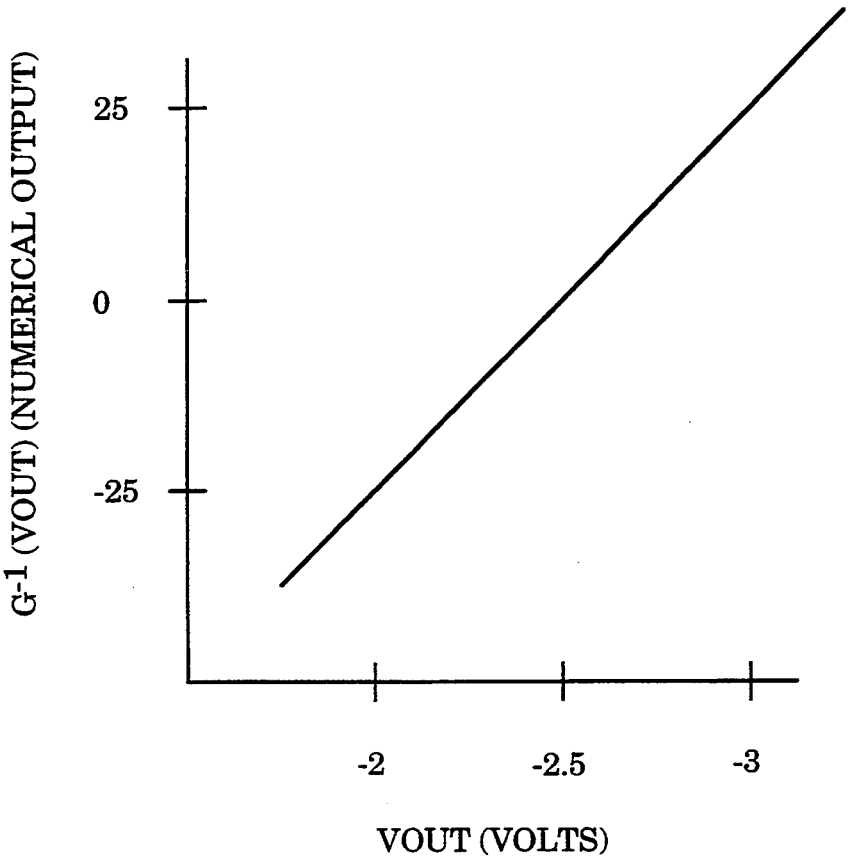

If an analog multiplier circuit is to multiply two numbers, the circuit may not be able to multiply electrical quantities that are the same as those numbers. For example, it may be desirable to multiply signals over a 1 volt range, but the numeric quantities may have a range of 10. The mapping functions are used to represent mathematical quantities (numbers) as electrical quantities (signals). FIG. 6*a* shows a mapping of numbers between −5 and +5 to electrical signals from −2.5 to −1.5 volts. FIG. 6*b* shows a similar mapping of numbers between −5 and 5 to the range of electrical signals from −5.5 to −4.5 volts. FIG. 6*c* shows a mapping to convert an output signal of the multiplier between −2 and −3 volts to a numeric representation between −25 and 25..

This explicit choice of representation and concrete mapping between numbers and signals enables the numeric range of the multiplier to be extended.

Figure 7A:
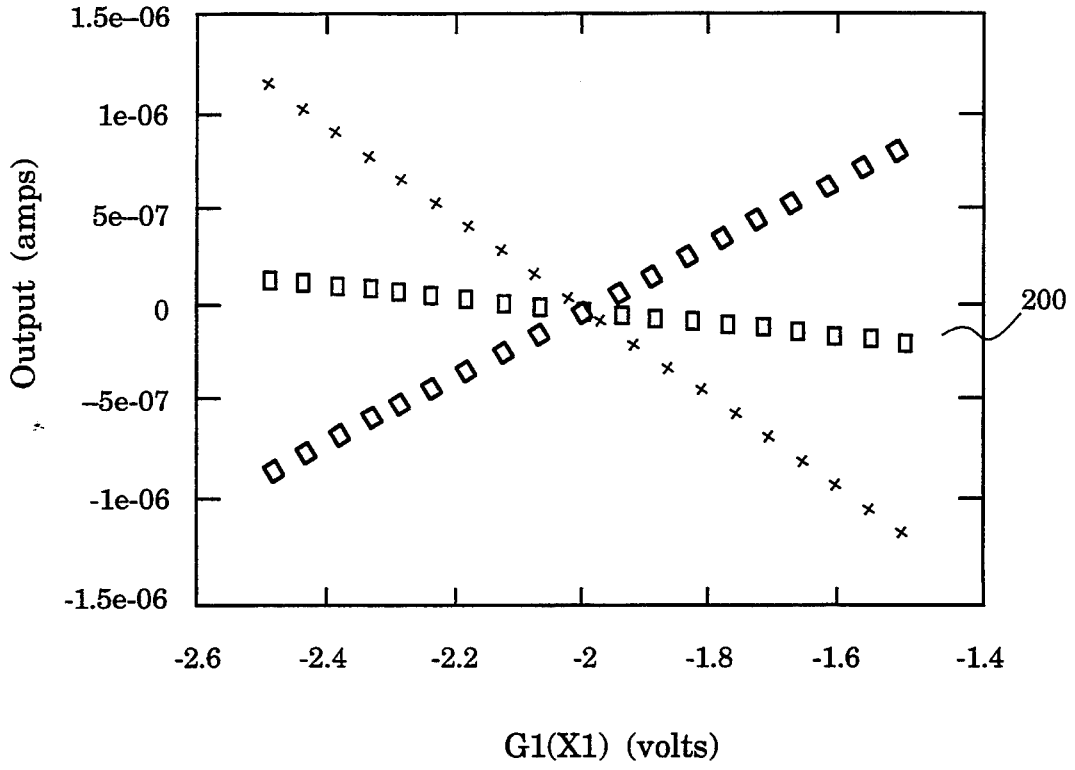
FIG. 7*a* is a diagram which illustrates the output results of a multiplier without compensation and FIG. 7*b* illustrates the results with compensation.

Using the signal to number mappings, the effects of compensation on the multiplier circuit can be shown. FIG. 7*a* illustrates the results of the two transistor multiplier before compensation. The graph shows one of the voltage inputs $G_1(X)$ of the multiplier on the horizontal axis mapped against the differential current output on the vertical axis. In the present example, for $G_1(X)$, −2.5 represents a large negative number, −2 volts represents mathematical 0, and −1.5 volts represents a large positive number. The number to signal mapping functions G1 and G2 map numeric ranges to the one volt input ranges of the multiplier. The three curves are produced by using three values for the other voltage input to the multiplier $G_2(W)$ which ranges from −5.5 to −4.5 volts, where−5 volts represents mathematical 0. It should be noted that non-zero offsets are present as evidenced by the non-zero slope line 200. This line 200 represents a result of multiplying 0 by a set of other quantities which should result in a horizontal line at 0.

Figure 7B:
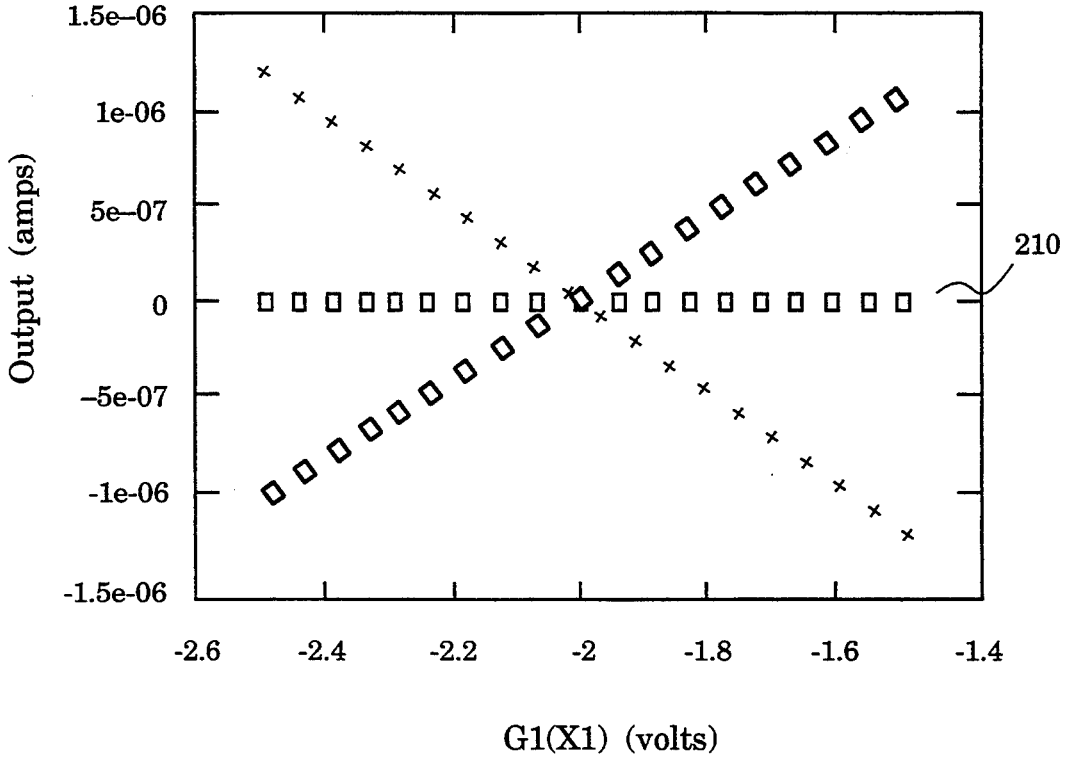

FIG. 7*b* shows the output from a compensated 2 transistor multiplier circuit in accordance with the teachings of the present invention. The graph shows one of the voltage inputs $G_1(X)$ of the multiplier on the X-axis mapped against the differential current output on the Y-axis. The three curves are produced from three values of the other voltage input to the multiplier, $G_2(W)$. The zero line 210 in the compensated multiplier is much closer to horizontal at 0, due to the effects of the compensation. The input offset error is less than one millivolt for a 1 volt input swing.

Figure 8:
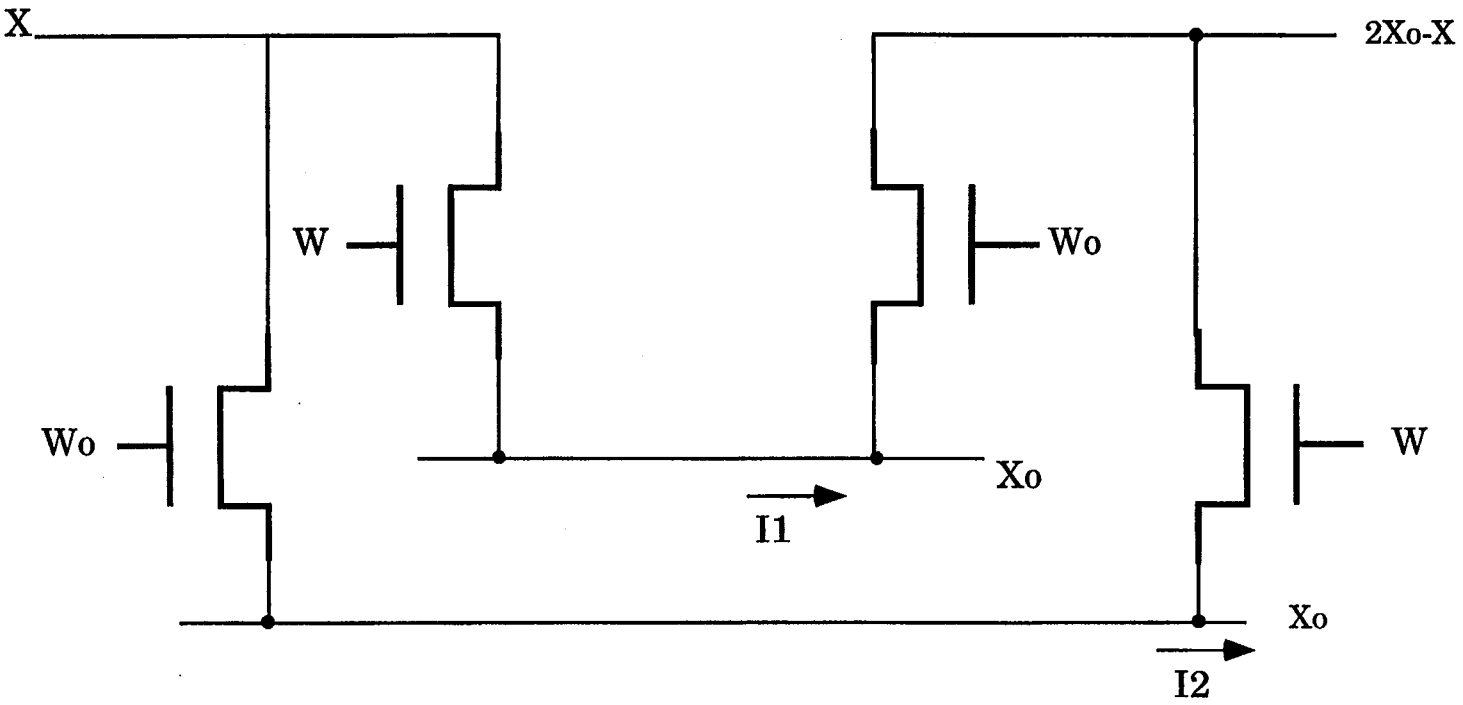
FIG. 8 is an illustration a four transistor multiplier.
Figure 9:
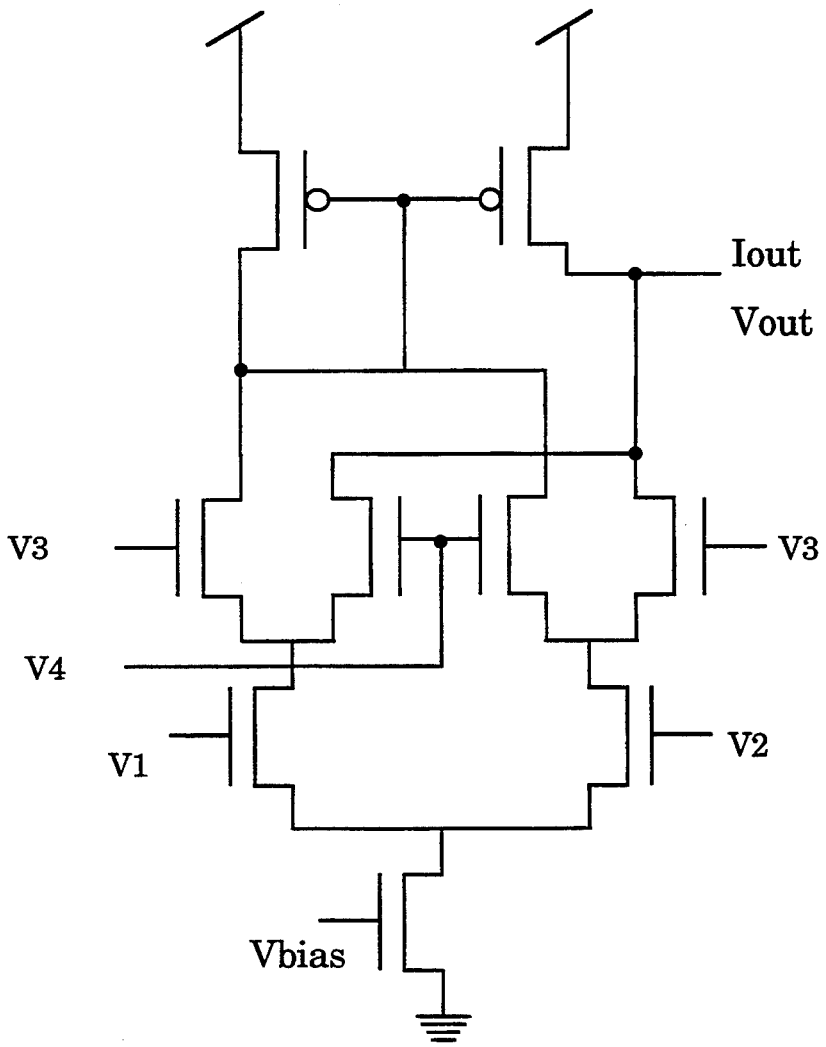
FIG. 9 is an illustration of a Gilbert transconductance multiplier.

This concept can be extended to a four transistor multiplier as shown in FIG. 8 or a Gilbert transconductance multiplier as shown in FIG. 9. In particular, referring to FIG. 8, higher order non-linearities can be canceled out using a four transistor multiplier design. The currents through the transistors are approximated as follows:

$$I1 = (W - X_0 - V_T)(X - X_0) + (X - X_0)^2 + (W_0 - X_0 - V_T)((2X_0 - X) - X_0) + \frac{1}{2}((2X_0 - X) - X_0)^2$$

$$I2 = (W_0 - X_0 - V_T)(X - X_0) + \frac{1}{2}((X - X_0)^2 + (W - X_0 - V_T)((2X_0 - X) - X_0) + \frac{1}{2}(2X_0 - X) - X_0)^2$$

Therefore, the difference current generated by the circuit is:

$$I_{diff} = 2(W - W_0)(X - X_0)$$

Figure 10:
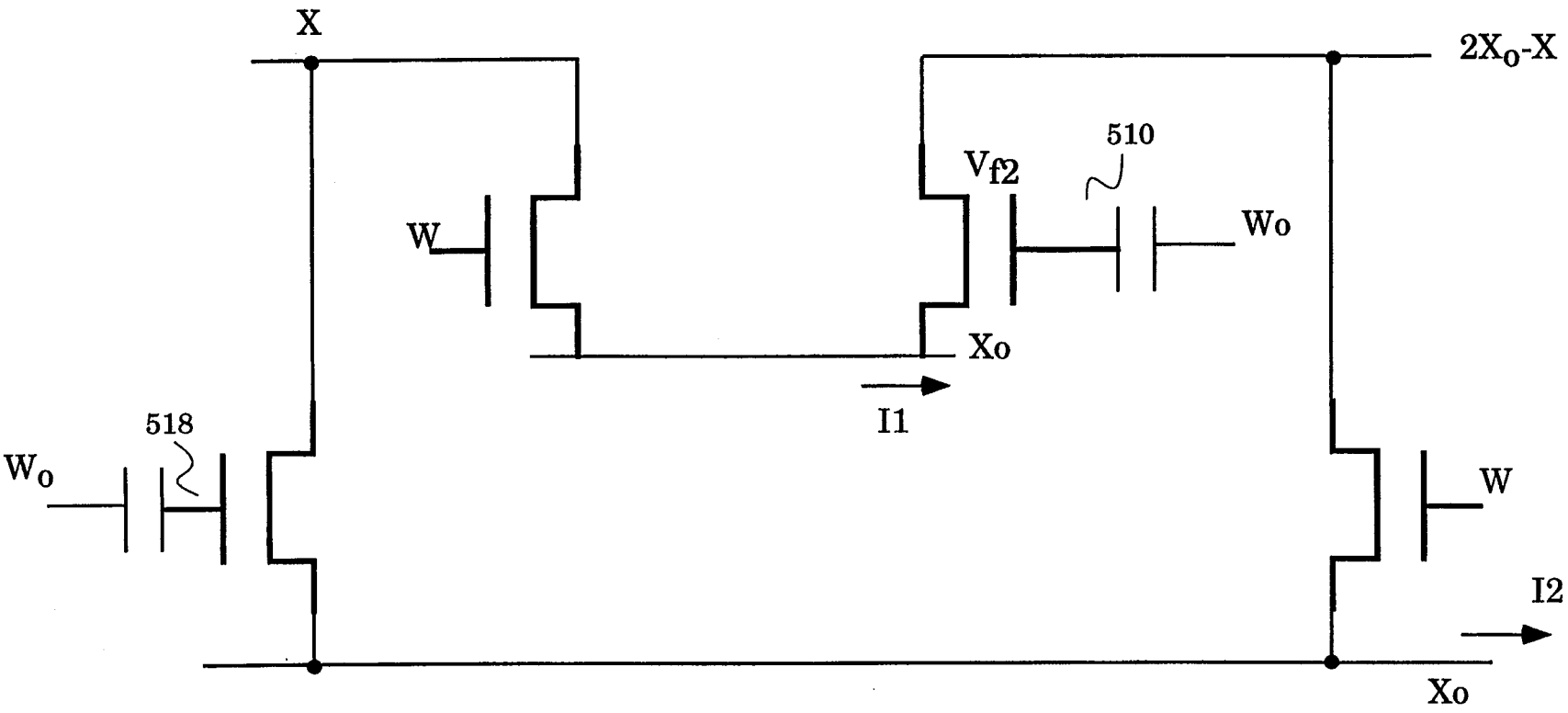
FIG. 10 is an illustration of a four transistor multiplier which includes additional parameters for compensation of input offsets.

A compensated four transistor differential amplifier is shown in FIG. 10. Compensation of the four transistor multiplier requires the adjustment of the two floating nodes, 510, 515. The floating nodes 510, 515 are adjusted so that the currents I1 and I2 are equal when inputs $W=W_0$ and $(X-X_0)$ is large, either positive or negative. The input offset corrections for X and X0 can be accomplished by adjusting the external circuitry that produces the values for X, $X_0$ and $(2X_0-X)$.

Figure 11:
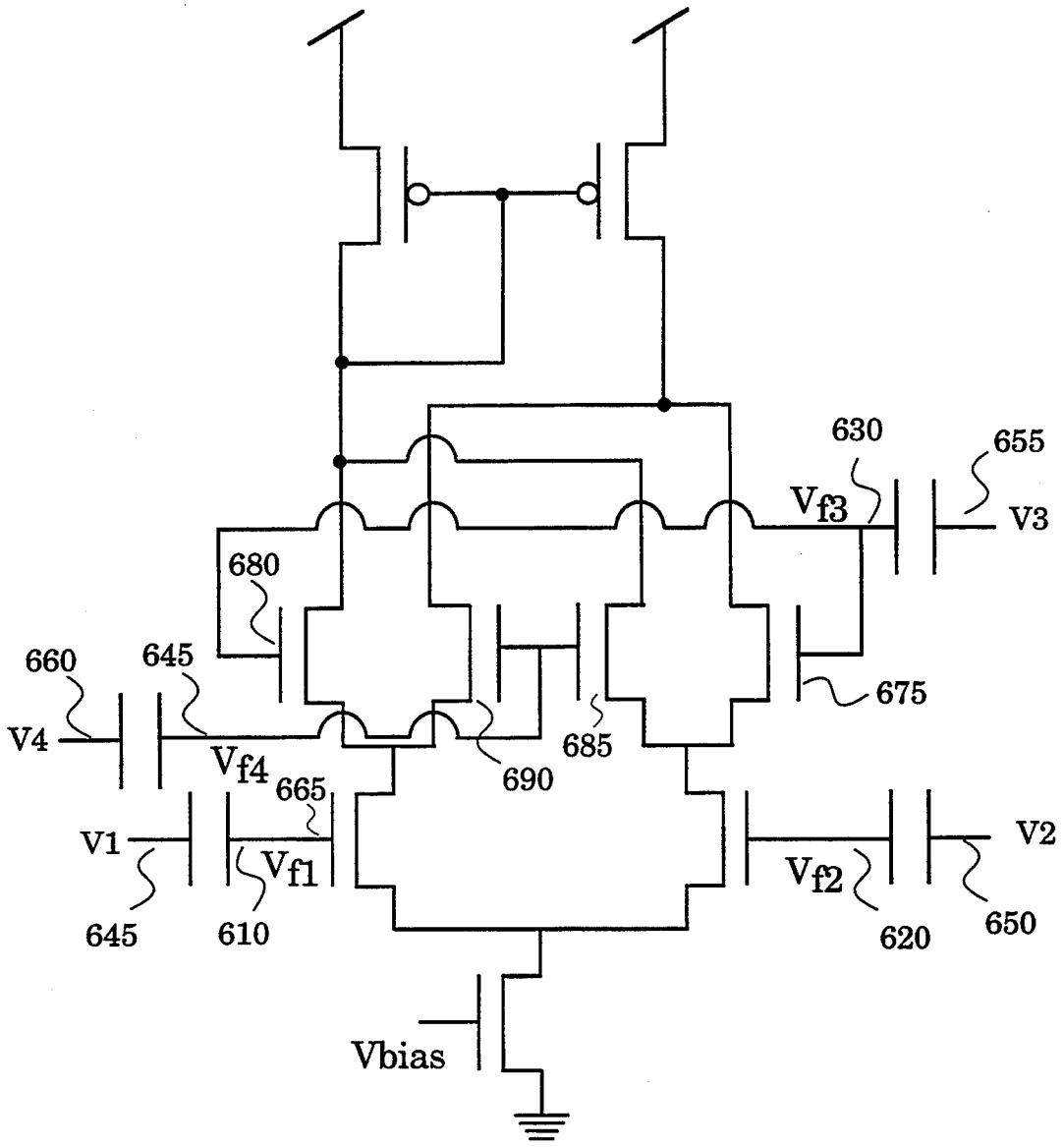
FIG. 11 is an illustration of a Gilbert transconductance multiplier which includes additional parameters for compensation of input offsets.

Similarly, as shown in FIG. 11, the concept can be applied to a Gilbert transconductance multiplier. The multiplier is supplied with four floating nodes 610, 620, 630, 640, coupled between the inputs 645, 650, 655, 660 and the gates of transistors 665, 670, 675, 680, 685, 690, respectively. The floating nodes are adjusted such that the multiplier produces the desired output for a given set of inputs. Preferably this is done empirically.

One of the easier methods, although not the only method, for compensation is to produce a "zero" output when the inputs are adjusted to values such that a "zero" output is expected. The "zero" is enclosed in quotation marks because it is not necessarily an electrical signal of 0 volts or 0 amps, but is the output value that is considered to identify "zero". This value will often actually be in roughly the middle of the output range of the multiplier.

The multiplier is adjusted so that it produces, a "zero" at the output when either (or both) of the differential inputs is zero (i.e., either w−w0, or x−x0, or both). Typically, the other differential input is made large in magnitude (either positive or negative), so that the multiplier will be multiplying zero by a worst case large number which should result in a value of 0.

In particular, the multiplier output should be "zero" for the following four sets of inputs:

$v1=v2$ and $v3<<v4$
$v1=v2$ and $v3>>v4$
$v3=v4$ and $v1<<v2$
$v3=v4$ and $v1>>v2$ The values for the floating gates should be chosen such that the value closest to "zero" for all four combinations of inputs is produced at the output. One way to optimize for multiple constraints is to evaluate the constraints and use gradient descent to perform the optimization.

Therefore, using gradient descent techniques, v1 is set to be equal to v2 and v3>>v4, and the error is evaluated to optimize for multiple constraints for the other three sets of inputs. Then, the four floating gates are adjusted slightly in the direction that would make the error smaller (this direction can be determined by making an adjustment and examining if the error got better or worse). The process can be repeated until the error is minimized.

Figure 12:
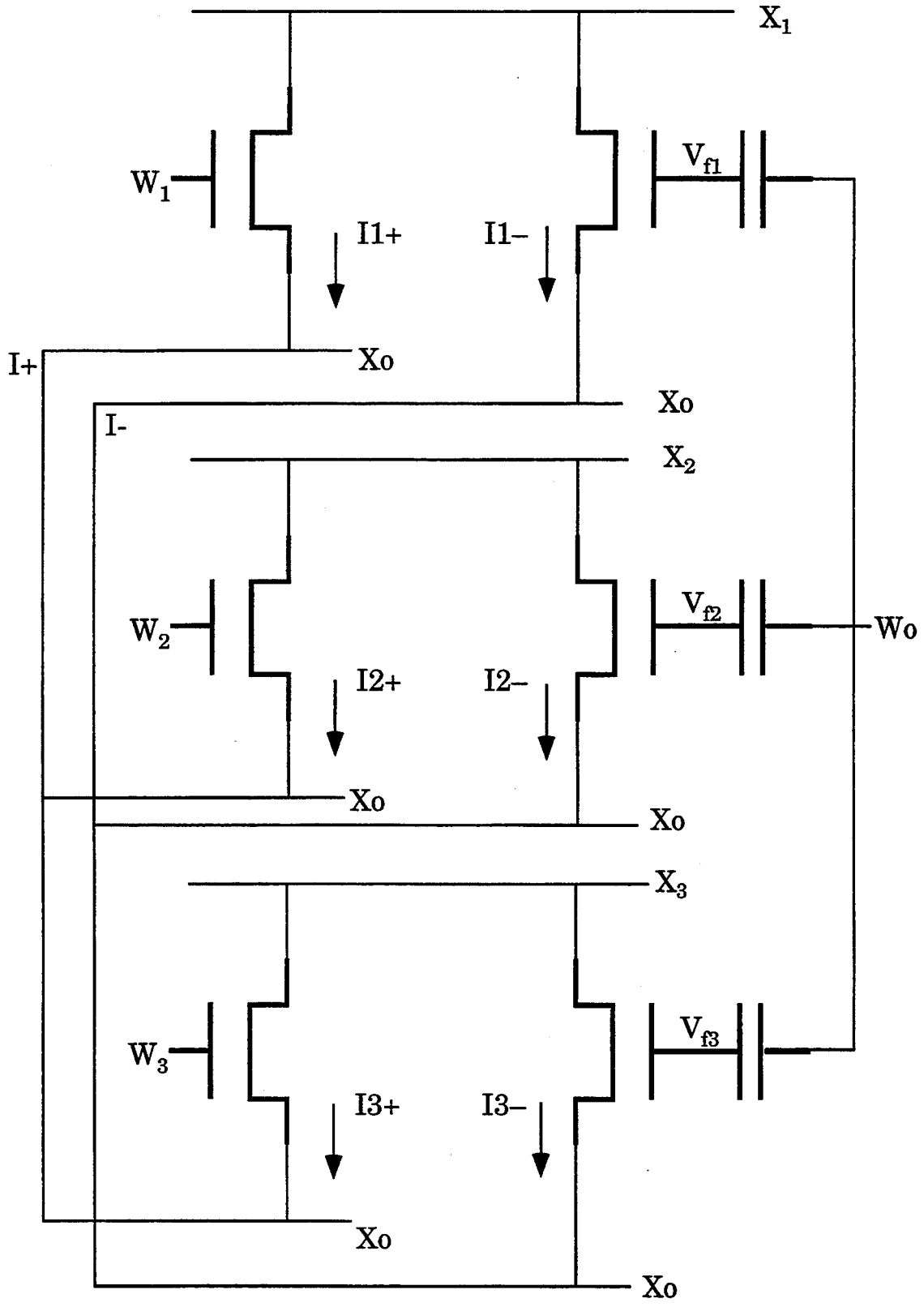
FIG. 12 is an illustration of a collection of multipliers which provide for compensation of offsets with respect to a single reference.

The concept can also be extended to a collection of multipliers such as circuit shown in FIG. 12. FIG. 12 shows three sets of two transistor multipliers connected to form a dot product calculation. A single reference voltage $W_0$, is utilized for the three inputs. Three floating gates $V_{f1}$, $V_{f2}$, and $V_{f3}$ are provided for individual compensation of the multipliers in the circuit. Therefore, similar techniques as described herein are performed individually to adjust $V_{f1}$, $V_{f2}$ and $V_{f3}$ relative to $W_0$ such that each of the three multipliers in the circuit are compensated for any affects caused by differences between the two transistors in each multiplier.

The invention has been described in conjunction with the preferred embodiment. It is evident that numerous alternatives, modifications, variations and uses will be apparent those skilled in the art in light of the foregoing description.

What is claimed is:

1. An analog multiplier which compensates for input offsets, said multiplier having a plurality of input nodes which are coupled to receive input signals and an output node which generates an output signal indicative of a product of the input nodes, said multiplier comprising:

at least one capacitor, each capacitor coupled between an input signal and a coupled input node;

at least one floating gate, each floating gate coupled between an input node and the coupled capacitor;

at least one floating gate control means, each means adjustable and coupled to the floating gate to control the amount of voltage at a floating node and therefore the amount of voltage at the coupled input node;

wherein the amount of voltage at each node having a capacitor, floating gate and floating gate control means is controlled to eliminate input offsets at the node.

2. The analog multiplier as set forth in claim 1, wherein the floating gate control means is adjusted to produce a predetermined output signal from known input signals.

3. The analog multiplier as set forth in claim 2, wherein the predetermined output signal corresponds to a numeric value of zero when at least one of the known input signal corresponds to a numeric value of zero, said floating gate control means adjusted as needed to produce an output signal corresponding to a numeric value of zero.

4. The analog multiplier as set forth in claim 1, wherein offsets are caused by errors in the input signals, said multiplier further comprising external circuitry to control the input signal values.

5. The analog multiplier as set forth in claim 4, wherein the external circuitry comprises at least one sense amplifier to adjust the input signal values.

6. The analog multiplier as set forth in claim 1, further comprising means for adjusting a linear range of the multiplier.

7. The analog multiplier as set forth in claim 6, wherein the means for adjusting the linear range of the multiplier comprises rescaling means coupled to receive the input signals prior to input to the multiplier circuit and output scaled input signals for input to the multiplier circuit wherein the scaled input signals are within the range of the multiplier but representing input signals of a greater range.

8. The analog multiplier as set forth in claim 7, wherein the rescaling means comprises second capacitors, each second capacitor coupled between each floating gate and ground to produce a floating node at a node of the second capacitor adjacent to the floating gate, such that each input signal is scaled by a factor (first capacitor)/(first capacitor–second capacitor).

9. The analog multiplier as set forth in claim 6, wherein the means for adjusting the linear range of the multiplier comprises external circuitry to adjust the input values comprising second capacitors, each second capacitor coupled between an input signal and an input to the multiplier and third capacitors, each third capacitor coupled between an input signal and ground, such that the input signal is scaled by the factor (second capacitor)/(second capacitor–third capacitor).

10. The analog multiplier as set forth in claim 6, wherein the means for adjusting the linear range comprises:

a first mapping means for mapping a numeric input range to an input signal range; and a second mapping means for mapping a numeric output range to an output signal range.

11. An analog multiplier circuit which compensates for input offsets, said multiplier having first, second third and fourth input nodes which receive inputs X, $X_0$, W, $W_0$ and generates an output product $P=K(X-X_0)(W-W_0)$, said multiplier circuit comprising:

a first capacitor located between the input $W_0$ and the fourth input node;

a first floating gate located between the first capacitor and the fourth input node;

a first floating gate control means coupled to the first floating gate to control the amount of voltage at the floating gate and therefore the amount of voltage at the fourth input node;

wherein the amount of voltage at the fourth input node is controlled to eliminate input offsets at the node.

12. The analog multiplier as set forth in claim 11, further comprising:

a second capacitor located between the input $X_0$ and the second input node;

a second floating gate located between the second capacitor and the second input node;

a second floating gate control means coupled to the second floating gate to control the amount of voltage at the second floating gate and therefore the amount of voltage at the second input node.

13. The analog multiplier as set forth in claim 11, further comprising a means for extending the linear range of the multiplier, comprising a third capacitive means coupled between the first floating gate and a ground reference to capacitively divide the input $X_0$ according to the following: $X_0=X_0*C1/(C1+C3)$, where C1 represents the value of the first capacitive means and C3 represents the value of the third capacitive means.

14. The analog multiplier as set forth in claim 12, further comprising a means for extending the linear range of the multiplier, comprising a fourth capacitive means coupled between the second floating gate and a ground reference to capacitively divide the input $W_0$ according to the following: $W_0 = W_0 * C1/(C1+C3)$, where C1 represents the value of the second capacitive means and C3 represents the value of the fourth capacitive means.

15. In an analog multiplier having a plurality of input nodes which are coupled to receive input signals and an output node which generates an output signal indicative of a product of the input nodes, a method for compensating for input offsets comprising:

providing at least one capacitor, each capacitor coupled between an input signal and a coupled input node;

providing at least one floating gate, each floating gate adjustable and coupled between an input node and the coupled capacitor;

controlling the amount of voltage at each floating gate wherein by controlling the amount of voltage at each floating gate, the amount of voltage at the coupled input node is controlled such that input offsets are eliminated.

16. The method as set forth in claim 15, wherein the step of controlling comprises the steps of:

inputting an input signal having a corresponding value of zero; and adjusting the voltage at the floating node such that the output signal of the multiplier corresponds to a value of zero.

17. The method as set forth in claim 15, further comprising the step of adjusting a linear range of the multiplier.

18. The method as set forth in claim 17, wherein the step of adjusting the linear range of the multiplier comprises the steps of rescaling the input signals prior to input to the multiplier circuit and outputting scaled input signals for input to the multiplier circuit wherein the scaled input signals are within the range of the multiplier but representing input signals of a greater range.

19. The method as set forth in claim 18, wherein the step of rescaling comprises the step of capacitively dividing the input signals.

20. The method as set forth in claim 17, wherein the step for adjusting the linear range comprises the steps of:

mapping a numeric input range to the input signal range; and mapping a numeric output range to the output signal range.

21. In an analog multiplier having a plurality of input nodes which are coupled to receive input signals having numeric values to be multiplied and an output node which generates an output signal indicative of a product of the numeric values of the input signals received at the input nodes, said analog multiplier operating within a fixed linear range of input signal values, a method for increasing the linear range of input signal values that the analog multiplier operates within, said method comprising the steps of:

mapping the numeric values input as input signals at the input nodes to a mapped input signal range that is within the fixed linear range of input signal values of the multiplier, said numeric values input as input signals being within a numeric range of values outside the linear range of input signal values;

said multiplier generating a product of the mapped input signal values; and remapping the product to the numeric signal range, wherein the linear range of values the multiplier operates within is expanded.

* * * * *